US006568114B1

(12) United States Patent
Klukan

(10) Patent No.: US 6,568,114 B1
(45) Date of Patent: May 27, 2003

(54) PHOTO ALBUM HAVING SLIDING DISPLAY INSERTS

(76) Inventor: Joel F. Klukan, P.O. Box 377, Woodstock, IL (US) 60098

( * ) Notice: Subject to any disclaimer, the term of this patent is extended or adjusted under 35 U.S.C. 154(b) by 0 days.

(21) Appl. No.: 10/154,873

(22) Filed: May 24, 2002

Related U.S. Application Data

(60) Provisional application No. 60/366,763, filed on Mar. 21, 2002.

(51) Int. Cl.[7] ..... A47G 1/06
(52) U.S. Cl. ..... 40/733; 40/735; 40/765
(58) Field of Search ..... 40/733, 735, 765, 40/771, 768, 769

(56) References Cited

U.S. PATENT DOCUMENTS

| | | | | | |
|---|---|---|---|---|---|
| 716,074 | A | * | 12/1902 | Magie | 40/733 |
| 873,050 | A | * | 12/1907 | Itter | 40/729 |
| 2,086,443 | A | * | 7/1937 | Rutyna | 40/733 |
| 3,382,595 | A | * | 5/1968 | Shore | 40/769 |
| 4,019,943 | A | * | 4/1977 | Holson | 156/227 |
| 4,562,656 | A | * | 1/1986 | Kristofich | 40/733 |
| 4,897,943 | A | * | 2/1990 | Otake | 40/768 |
| 5,105,567 | A | * | 4/1992 | Real | 40/765 |
| 5,584,135 | A | * | 12/1996 | Hosker | 40/800 |
| 5,626,926 | A | * | 5/1997 | Roberts | 428/14 |
| 6,012,245 | A | * | 1/2000 | Squitieri | 40/735 |
| 6,205,693 | B1 | * | 3/2001 | Pliler et al. | 40/776 |

* cited by examiner

*Primary Examiner*—Gary Hoge
(74) *Attorney, Agent, or Firm*—Donald J. Ersler

(57) ABSTRACT

A photo album having display inserts includes a base body, a first folding body, a second folding body, a base display insert, a first display insert, and a second display insert. The first folding body is pivotally attached to one side of the base body and the second folding body is pivotally attached to the other side of the base body. The first display insert is slidably received by the first folding body. The second display insert is slidably received by the second folding body. The base display insert is slidably received by the base body. At least one display window is formed through the first display insert, the second display insert, and the base display insert. A photograph or the like is attached to the area surrounding the display opening on a back side of the display insert.

10 Claims, 3 Drawing Sheets

PHOTO ALBUM HAVING SLIDING DISPLAY INSERTS

Cross-References to Related Applications

This is a utility patent application taking priority from provisional application No. 60/366,763 filed on Mar. 21, 2002.

BACKGROUND OF THE INVENTION

1. Field of the Invention

The present invention relates generally to photo albums and more specifically to a photo album having sliding display inserts which allows photographs or the like to be retained in a display insert and the display insert easily inserted or removed from the photo album.

2. Discussion of the Prior Art

There are numerous types of photo albums on the market. Some of these photo albums use paper surfaces to retain photographs or the like. The photographs or the like are retained by sliding a photograph in from a side or top of the photo album. Sliding a photograph into a paper slot may be time consuming and a difficult task for some people. Further, it appears there is no photo album with an insertable face, where photographs are attached to the insertable face and slid into the photo album. Additionally, some potential buyers may not be satisfied with a photo album fabricated from paper.

Accordingly, there is a clearly felt need in the art for a photo album having sliding display inserts, where the sliding display inserts may be easily removed or inserted into the photo album; and where an item may be easily attached to a sliding display insert.

SUMMARY OF THE INVENTION

The present invention provides a photo album having sliding display inserts, such that photographs or the like may be easily inserted into the photo album. The photo album having display inserts includes a base body, a first folding body, a second folding body, a base display insert, a first display insert, and a second display insert. The first folding body is pivotally attached to one side of the base body and the second folding body is pivotally attached to the other side of the base body. A first slide retainer is formed on each side of the first folding body. A second slide retainer is formed on each side of the second folding body. A base slide retainer is formed on each side of the base body. An inward facing groove is formed in each slide retainer.

A first lengthwise tongue is formed on each side of the first display insert. A second lengthwise tongue is formed on each side of the second display insert. A base lengthwise tongue is formed on each side of the base display insert. Each lengthwise tongue is slidably received by a single inward facing groove. At least one display window is formed through the first display insert. At least one display window is formed through the second display insert. At least one display window formed through the base display insert. A photograph or the like is attached to the area surrounding the display window on a back side of the display insert.

Accordingly, it is an object of the present invention to provide a photo album having sliding display inserts, where the display inserts may be easily removed or inserted into the photo album.

Finally, it is another object of the present invention to provide a photo album having sliding display inserts, where an item may be easily attached to the display insert.

These and additional objects, advantages, features and benefits of the present invention will become apparent from the following specification.

DETAILED DESCRIPTION OF THE PREFERRED EMBODIMENTS

Figure 1:
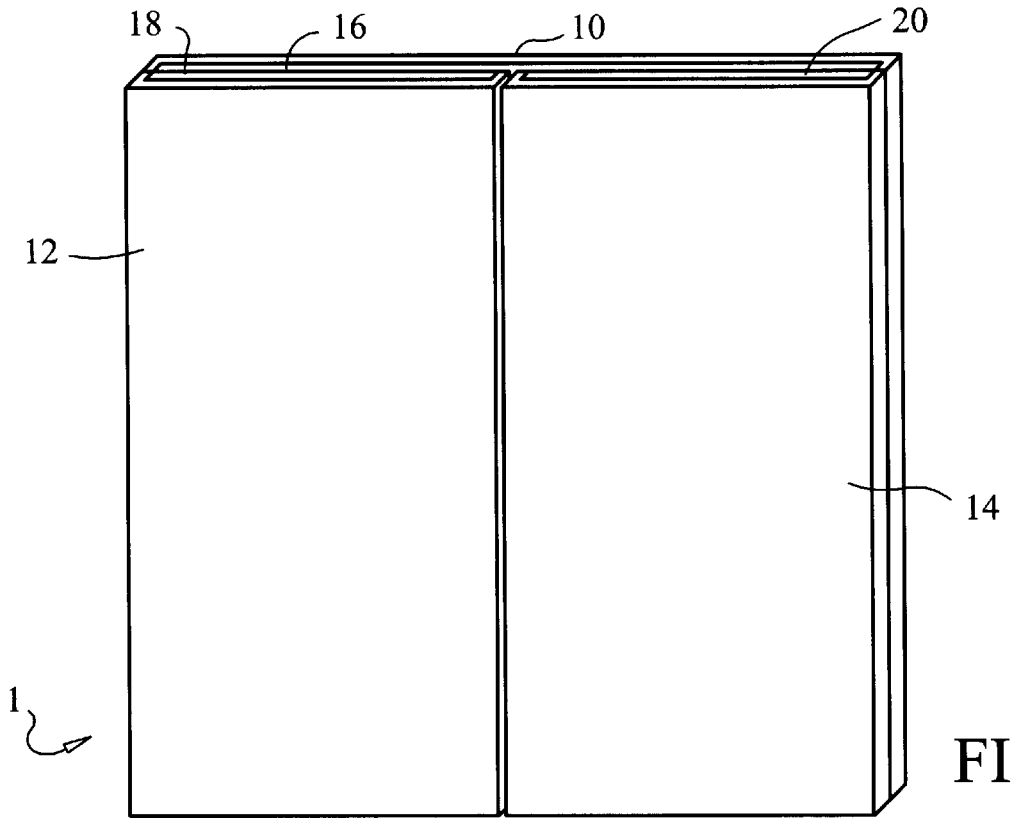
FIG. 1 is a perspective view of a photo album having sliding display inserts in a closed orientation in accordance with the present invention.
Figure 2:
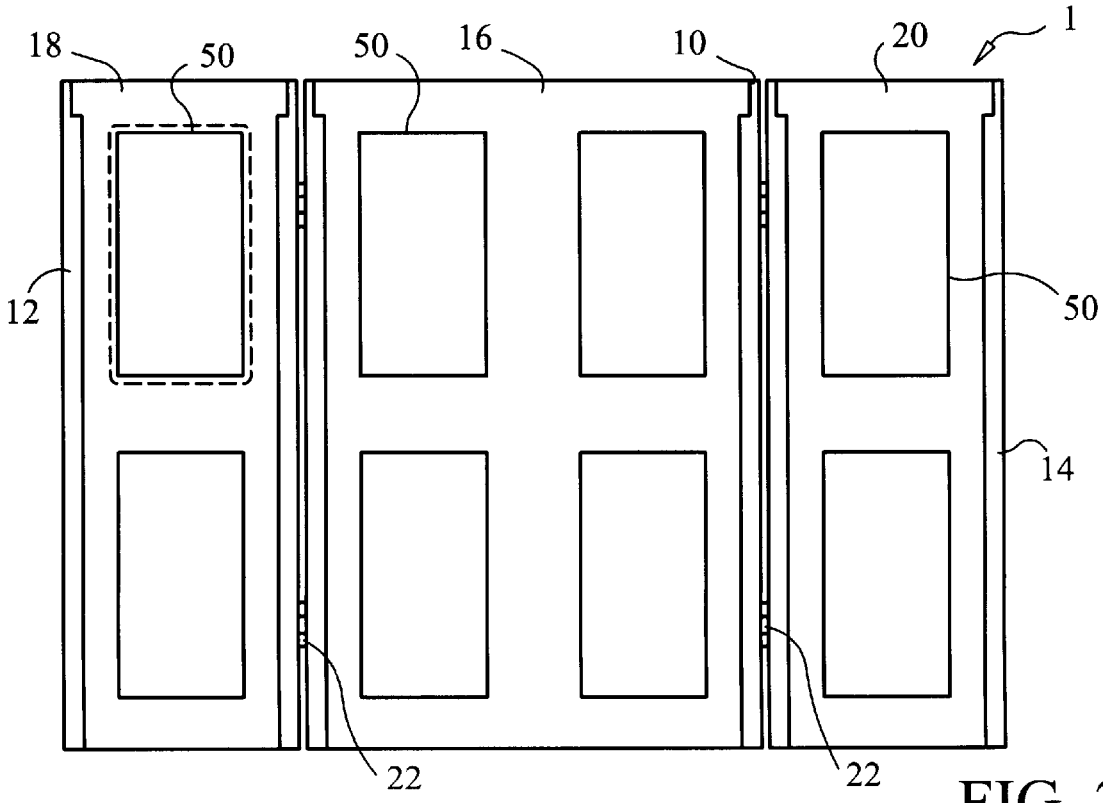
FIG. 2 is a front view of a photo album having sliding display inserts in a fully opened orientation in accordance with the present invention.
Figure 3:
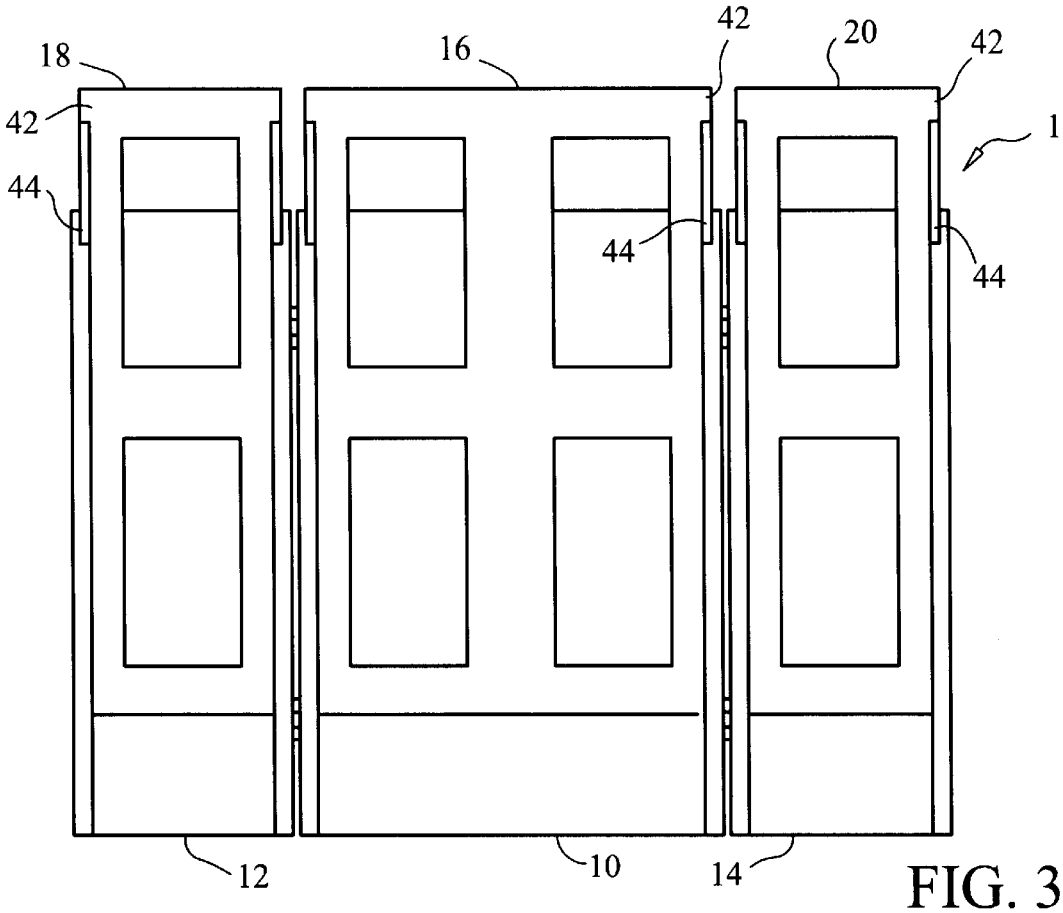
FIG. 3 is a front view of a photo album having sliding display inserts with the display inserts partially removed from the photo album in accordance with the present invention.

With reference now to the drawings, and particularly to FIG. 1, there is shown a perspective view of a photo album having sliding display inserts 1. With reference to FIGS. 2–3, the photo album having display inserts 1 includes a base body 10, a first folding body 12, a second folding body 14, a base display insert 16, a first display insert 18, and a second display insert 20. Preferably, the width of each folding body is one half the width of the base body 10. Each body and each display insert is preferably fabricated from medium density fiberboard (MDF), but other materials may also be used.

Figure 4:
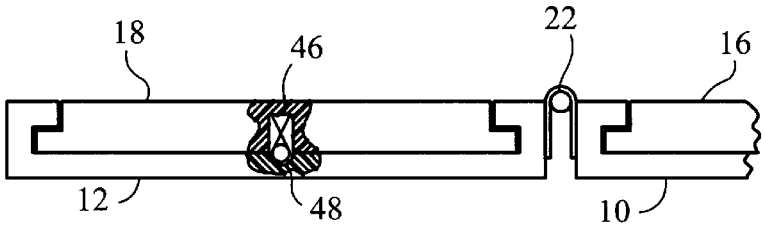
FIG. 4 is an enlarged bottom end view of a first folding body pivotally attached to a base body of a photo album having sliding display inserts in accordance with the present invention.

With reference to FIG. 4, the first folding body 12 is preferably pivotally attached to one side of the base body 10 with at least one hinge 22, but other pivotal attachment methods may also be used. The second folding body 14 is preferably pivotally attached to the other side of the base body 10 with at least one hinge 22, but other pivotal attachment methods may also be used. The at least one hinge 22 is attached to the base body 10 and either folding body with fasteners or the like.

Figure 5:
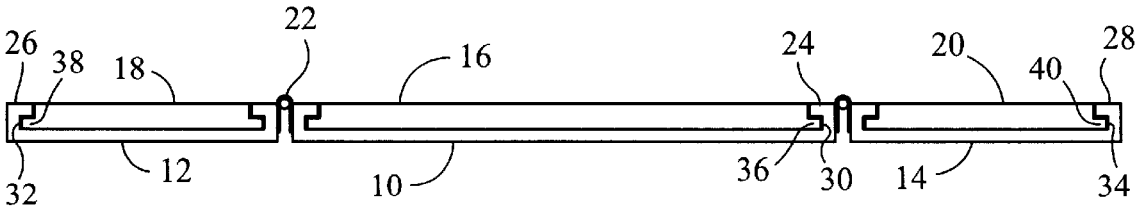
FIG. 5 is a bottom end view of a photo album having sliding display inserts in accordance with the present invention.

With reference to FIG. 5, a base slide retainer 24 is formed on each side of the base body 10. A first slide retainer 26 is formed on each side of the first folding body 12. A second slide retainer 28 is formed on each side of the second folding body 14. A base inward facing groove 30 is formed in each base slide retainer 26. A first inward facing groove 32 is formed in each first slide retainer 28. A second inward facing groove 34 is formed in each second slide retainer 28. A base lengthwise tongue 36 is formed on each side of the base display insert 16. A first lengthwise tongue 38 is formed on each side of the first display insert 18. A second lengthwise tongue 40 is formed on each side of the second display insert 34. Each lengthwise tongue is sized to be slidably received by its respective inward facing groove. Other methods of slidably retaining the display inserts in their respective body may also be used.

Preferably, each lengthwise tongue is terminated with a retention tab 42. A tab recess 44 is formed in each slide retainer to receive each retention tab 42. The retention tab 42 prevents each display insert from sliding out the bottom of its respective body. A single retention tab 42 may also be used to retain each display insert. Other methods may also be used to prevent each display insert from sliding out of a bottom of its respective body.

Preferably, a top retention device prevents each display insert from sliding-out-of a top its respective body. Such a top retention device could include a spring loaded detent 46 and a mating cavity 48. The spring loaded detent 46 would be retained in the display insert and the mating cavity 48 formed in its respective body. However, other top retention devices could also be used.

Figure 6:
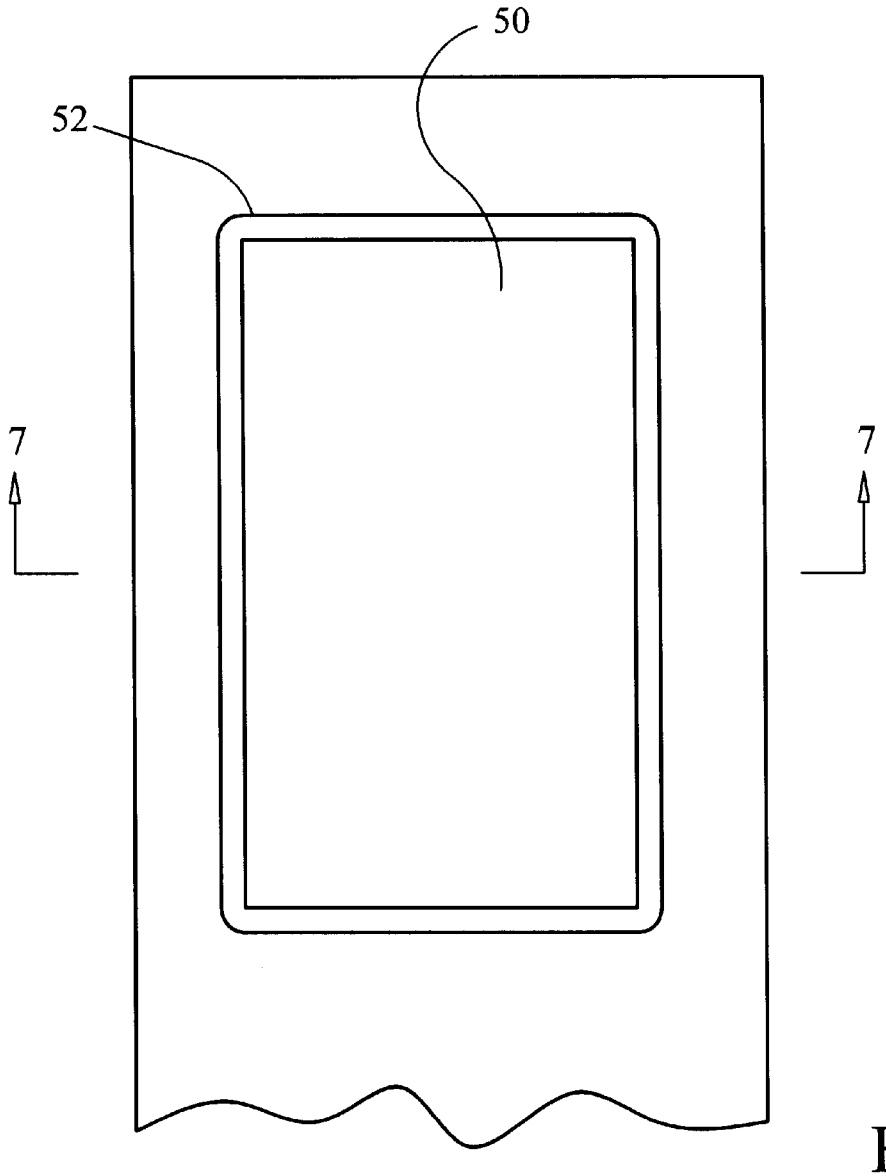
FIG. 6 is a back view of a display window in a display insert of a photo album having sliding display inserts in accordance with the present invention.
Figure 7:
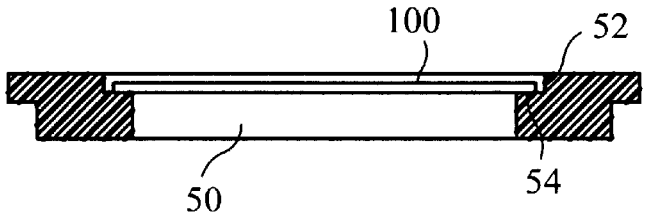
FIG. 7 is a cross sectional view of a display insert with the back facing upward of a photo album having sliding display inserts in accordance with the present invention.

With reference to FIGS. 6 & 7, at least one display window 50 is formed through the first display insert 18. At least one display window 50 is formed through the second display insert 20. At least one display window 50 formed through the base display insert 16. Preferably, a mounting area 52 is formed on a back side of each display window 50 to receive a photograph 100 or the like. The shape of the display window 50 should not be limited to a rectangle, but can be any appropriate shape such as oval, round, or a hexagon. The photograph 100 or any other type material to be displayed (the like) is preferably attached to the mounting area 52 with a reusable adhesive 54 or other suitable attachment method. The reusable adhesive 54 is preferably applied to the mounting area 52, before attachment of the photograph 100 or like.

While particular embodiments of the invention have been shown and described, it will be obvious to those skilled in the art that changes and modifications may be made without departing from the invention in its broader aspects, and therefore, the aim in the appended claims is to cover all such changes and modifications as fall within the true spirit and scope of the invention.

I claim:

1. A photo album having sliding display inserts comprising:

a base body;

a first folding body being pivotally attached to one side of said base body and a second folding body being pivotally attached to the other side of said base body;

a base display insert being slidably received by said base body, a first display insert being slidably received by said first folding body, a second display insert being slidably received by said second folding body;

at least one display window being formed in each said display insert;

a slide retainer being formed on each side of each said body, an inward facing groove being formed in each slide retainer;

a lengthwise tongue being formed on each side of each display insert, each said lengthwise tongue being sized to be slidably receive by its respective inward facing groove; and a retention tab terminating at least one lengthwise tongue on each said display insert, a single tab recess being formed in each said body to receive a single said retention tab.

2. The photo album having sliding display inserts of claim 1, further comprising:

at least one hinge being attached to said first folding body and the one side of said base body and at least one hinge being attached to said second folding body and the other side of said base body.

3. The photo album having sliding display inserts of claim 1 wherein:

a mounting area being formed on a back side of each said display insert adjacent each said display window.

4. The photo album having sliding display inserts of claim 1 wherein:

a top retention device being used to prevent a display insert from falling out of its respective body.

5. A photo album having sliding display inserts comprising:

a base body;

a first folding body being pivotally attached to one side of said base body and a second folding body being pivotally attached to the other side of said base body;

a base display insert being slidably received by said base body, a first display insert being slidably received by said first folding body, a second display insert being slidably received by said second folding body; and at least one display window being formed in each said display insert;

a slide retainer being formed on each side of each said body, an inward facing groove being formed in each slide retainer;

a lengthwise tongue being formed on each side of each display insert, each said lengthwise tongue being sized to be slidably received by its respective inward facing groove;

a retention tab terminating at least one lengthwise tongue on each said display insert, a single tab recess being formed in each said body to receive a single said retention tab; and a top retention device being used to prevent a display insert from falling out of its respective body.

6. The photo album having sliding display inserts of claim 5, further comprising:

at least one hinge being attached to said first folding body and the one side of said base body and at least one hinge being attached to said second folding body and the other side of said base body.

7. The photo album having sliding display inserts of claim 5, wherein:

a mounting area being formed on a back side of each said display insert adjacent each said display window.

8. A photo album having sliding display inserts comprising:

a base body;

a first folding body being pivotally attached to one side of said base body and a second folding body being pivotally attached to the other side of said base body;

a base display insert being slidably received by said base body, a first display insert being slidably received by said first folding body, a second display insert being slidably received by said second folding body; and at least one display window being formed in each said display insert;

a slide retainer being formed on each side of each said body, an inward facing groove being formed in each slide retainer;

a lengthwise tongue being formed on each side of each display insert, each said lengthwise tongue being sized to be slidably received by its respective inward facing groove;

a retention tab terminating at least one lengthwise tongue on each said display insert, a single tab recess being formed in each said body to receive a single said retention tab; and a mounting area being formed on a back side of each said display insert adjacent each said display window.

9. The photo album having sliding display inserts of claim 8, further comprising:

at least one hinge being attached to said first folding body and the one side of said base body and at least one hinge being attached to said second folding body and the other side of said base body.

10. The photo album having sliding display inserts of claim 8 wherein:

a top retention device being used to prevent a display insert from falling out of its respective body.

* * * * *